United States Patent [19]

Kanesaki

[11] Patent Number: 5,067,320

[45] Date of Patent: Nov. 26, 1991

[54] EXHAUST PARTICLE REMOVING SYSTEM FOR INTERNAL COMBUSTION ENGINE

[75] Inventor: Nobukazu Kanesaki, Kanagawa, Japan

[73] Assignee: Nissan Motor Company, Limited, Japan

[21] Appl. No.: 467,397

[22] Filed: Jan. 22, 1990

[30] Foreign Application Priority Data

Jan. 24, 1989 [JP] Japan ..... 1-13155

[51] Int. Cl.[5] ..... F01N 3/02

[52] U.S. Cl. ..... 60/297; 60/280; 60/303; 422/169

[58] Field of Search ..... 60/297, 303, 280; 422/169, 170, 171

[56] References Cited

U.S. PATENT DOCUMENTS 4,054,418 10/1877 Miller et al. ..... 60/297
4,934,142 6/1990 Hayashi ..... 422/169

FOREIGN PATENT DOCUMENTS 89756 9/1983 European Pat. Off. .
153157 8/1985 European Pat. Off. .
3219947 12/1983 Fed. Rep. of Germany .
3522431 1/1987 Fed. Rep. of Germany .
2040182 8/1980 United Kingdom .

*Primary Examiner*—Douglas Hart
*Attorney, Agent, or Firm*—Lowe, Price, LeBlanc & Becker

[57] ABSTRACT

An exhaust particle removing system for an internal combustion engine includes two filters disposed within an exhaust passage in series for trapping particles suspended in exhaust gas. The system also includes combustion equipment which is disposed near the inlet of the upstream filter, and serves to burn off the particles deposited on the upstream filter. The downstream filter is coated with a catalyst. The downstream filter is arranged to be separate from the upstream filter by a predetermined distance so that the particles deposited on the downstream filter can be burned off by means of an elevated temperature of gas passing through the upstream filter. The length of each of the filters is essentially equal to or less than the diameter of the inlet of the respective filter.

6 Claims, 4 Drawing Sheets

EXHAUST PARTICLE REMOVING SYSTEM FOR INTERNAL COMBUSTION ENGINE

BACKGROUND OF THE INVENTION

1. Field of the Invention

The present invention relates to a system for removing particles from exhaust produced by internal combustion engines.

2. Description of the Prior Art

Exhaust produced by internal combustion engines, particularly diesel engines, includes many exhaust particles. The principal constituents of which are carbon and other components which are soluble in organic solvents (These components will be referred to as SOF). Therefore, in order to clean the exhaust for preventing the emission of exhaust particles into the atmosphere, a filter is provided within an exhaust passage to trap particles.

Such an exhaust particle removing system is described in part in S.A.E. paper 88006 and Japanese Patent First publications (Tokkai Sho.) Nos. 57-212318, 59-150918 and 60-150414.

In internal combustion engines, as described in the aforementioned publications, a filter for trapping exhaust particles is disposed within an exhaust passage of the engine. The exhaust passage branches upstream of the filter for establishing a bypass passage within which a muffler or silencer is disposed. At the branching point between the bypass passage and the exhaust passage, a directional control valve is provided. In addition, a burner is also disposed upstream of the filter. The burner causes exhaust particles, which were trapped by the filter to be deposited thereon, to reborn to preventing the pores of the filter from being blocked.

While the vehicle is in motion, the bypass passage is usually closed by means of the directional control valve, and the exhaust passes through the filter so that the exhaust particles are trapped by the filter to clean the exhaust.

An exhaust-pressure sensor monitors whether or not the volume of the exhaust particles trapped by the filter is greater than a preselected value. When it is detected that the trapped volume becomes greater than the preselected value, the exhaust particles trapped in the filter are burned by the burner to reclaim the filter. In this way, the exhaust pressure is so controlled as to prevent it from increasing excessively, so that reduced the output and increased fuel consumption of the internal combustion engine is prevented.

Since a great amount of exhaust particles synchronously begin to burn during reclaiming the filter, it is noted that if the preselected value is too high, cracking occurs in the filter and/or the filter is damaged by melting thereof. On the other hand, when the aforementioned preselected value is too low, reclaiming must be frequently performed, so that fuel consumption is increased and degradation of the burner is accelerated. Therefore, the preselected value is carefully selected to balance these points.

However, in such conventional exhaust particle removing systems, particularly in the case of motor coaches, trucks and so forth, there are the following disadvantages.

Since the volume of the filter mounted on a motor coach is very large, a great difference in temperature distribution occurs within the filter during reclaiming, so that reclaiming is not performed evenly. In the worst case, burnout occurs due to heat distortion in the filter.

With conventional filters, there is another disadvantage in that gaseous SOF constituents in the exhaust particles can not be trapped, so that they are emitted into the atmosphere.

SUMMARY OF THE INVENTION

It is therefore a principal object of the invention to eliminate the aforementioned disadvantage and to provide an exhaust particle removing system for an internal combustion engine which can prevent filter burnout even in a motor coach, a truck or the like, as well as preventing SOF constituents from being emitted into the atmosphere.

In order to accomplish the aforementioned and other specific objects, the exhaust particle removing system includes two filters disposed within an exhaust passage in series for trapping particles suspended in exhaust gas, and a combustion equipment which is disposed near the inlet of the upstream filter and which serves to burn off particles deposited on the upstream filter. Preferably, the downstream filter is coated with a catalyst, and is arranged to be separate from the upstream filter by a predetermined distance so that the particles deposited on the downstream filter can be burned off by means of an elevated gas temperature passing through the upstream filter. The length of each of the filters is essentially equal to or less than the diameter of the inlet of the respective filter.

According to one aspect of the invention, the exhaust particle removing system for an engine comprises:

a first filter disposed in an engine exhaust passage for trapping particles suspended in exhaust gas;

combustion means disposed near the inlet of the first filter for burning off the particles deposited on the first filter; and a second filter, which is disposed in the engine exhaust passage downstream of the first filter in series thereto and coated with a catalyst, for trapping particles suspended in exhaust gas passing through the first filter, the second filter being separate from the first filter by a predetermined distance so that the particles deposited on the second filter may be burned off by means of an elevated gas temperature passing through the first filter.

Each of the first and second filters may comprise a honeycomb structure, and have a plurality of parallel holes extending between the upstream and downstream ends of the respective filter. The holes may be of first and second types, the holes of the first type having open upstream ends and closed downstream ends, the holes of the second type having open downstream ends and closed upstream ends, the first holes adjoining the second holes via porous walls of the respective filter so that the exhaust gas first enters the first holes and then passes through the porous walls into the second holes before exiting via the second holes. The length of each of the first and second filters is preferably essentially equal to or less than the diameter of the inlet of the respective filter. The catalyst may have the ability to oxidize and reduce gaseous SOF, HC, CO contained in the particles. Upstream exhaust from a turbo-supercharger of the engine may be introduced into the combustion means for burning the particles.

DESCRIPTION OF THE PREFERRED EMBODIMENT

Figure 1:
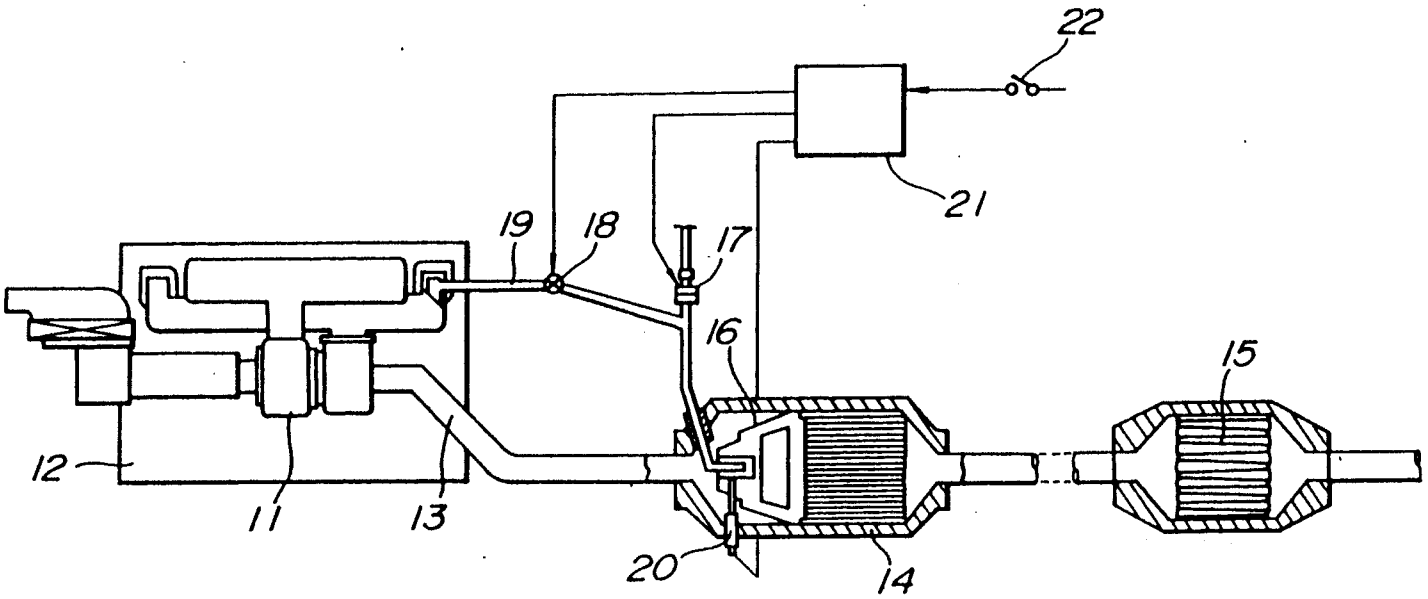
FIG. 1 is a schematic view of the preferred embodiment of an exhaust particle removing system for an internal combustion engine according to the present invention.

Referring now to the drawings, particularly to FIG. 1, an internal engine 12, such as a diesel engine, is equipped with a turbo-supercharger 11. The internal engine 12 includes an exhaust passage 13 within which first and second filters 14 and 15 of an essentially cylindrical, honeycomb structure are disposed in series. Each of the first and second filters 14 and 15 has a plurality of parallel holes extending between the upstream and downstream ends of its filter. These holes are of two types. The holes of the first type have open upstream ends and closed downstream ends. The holes of the second type have open downstream ends and closed upstream ends. The first holes adjoin the second holes via the porous walls of the filter so that the exhaust gas first enters the first holes and then passes through the porous walls into the second holes before exiting via the second holes. As the exhaust gas passes through the porous walls, particles suspended in this gas are trapped by the walls.

In addition, the first and second filters 14 and 15 are respectively formed so that the width of a plane, which is essentially perpendicular to the axis along the exhaust flow passing therethrough, is essentially equal to the length thereof. The average diameter of pores in the walls of the first and second filters 14 and 15 are about 20$\mu$, and the trapping efficiency thereof is set at about 40%. The second downstream filter 15 is coated with a catalyst, and the first upstream filter 14 is not coated therewith.

The exhaust passage 13 is also provided with combustion equipment 16 serving as a heating element near the inlet of the first filter 14. The combustion equipment 16 is supplied with fuel via an injection nozzle 17. In addition, exhaust is introduced into the combustion equipment 16 from the upstream of a rotor of the turbo-supercharger 11 through a passage 19 within which a passage closing valve 18 is disposed. The combustion equipment 16 is equipped with a glow plug 20 for firing.

The injection nozzle 17, the passage closing valve 18 and the glow plug 20 are controlled by means of a control unit 21 comprising a microcomputer or so forth. The control unit 21 is operable in response to turning ON of a manually operable reclaiming start switch 22. When the switch 22 is turned on, the control unit 21 operates according to a flow chart shown in FIG. 2 to cause the injection nozzle 17, the passage closing valve 18 and the glow plug 20 to operate. In addition, the exhaust particle removing system has also a warning lamp (not shown) which informs the driver that the reclaiming of the filter is required on the basis of driving distance or driving time. The reclaiming time is set to be sufficient for the vehicle to come back to a garage after one time driving.

The operation of the exhaust particle removing system for an internal combustion engine, according to the present invention, is described below.

Figure 2:
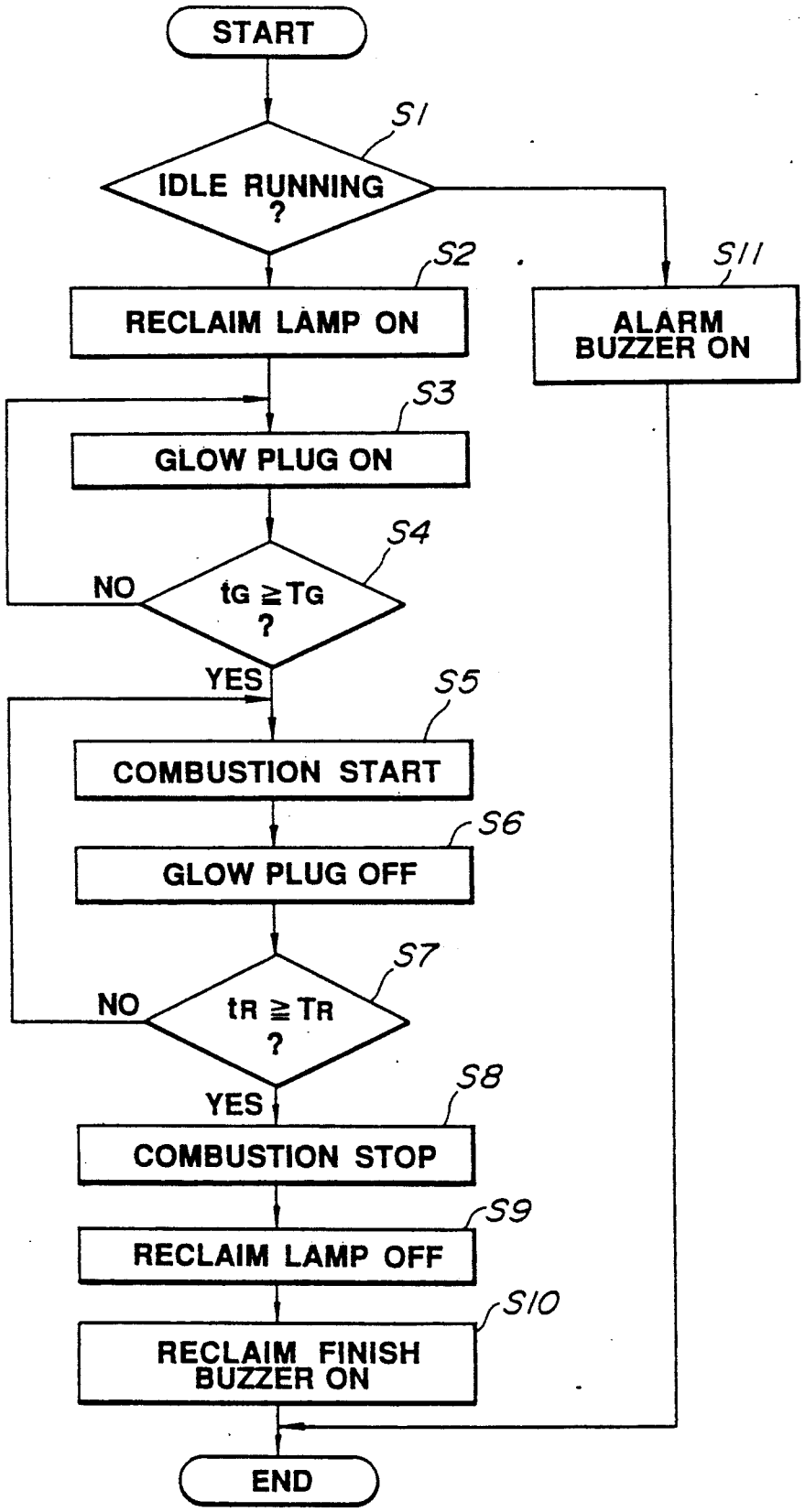
FIG. 2 is a flow chart showing a process for controlling the exhaust particle removing system of FIG. 1.

FIG. 2 shows control process of the exhaust particle removing system according to the present invention. After the vehicle returns to its garage, or the like, if the alarm lamp is turned on, a driver or mechanic causes the internal combustion engine to idle and the reclaiming start switch 22 to be turned on. At this time, the routine shown in FIG. 2 starts to execute. At a step 1, it is determined whether or not the engine is idling or not. If it is determined that the engine is idling, the routine goes to a step 2, and if the engine is not idling, the routine goes to a step 11. When the engine is running in a low-speed, non-load condition in which a great amount of oxygen for combustion is included in the atmosphere, the routine may also go to the step 2.

At the step 11, an alarm buzzer is turned on to inform the driver or mechanic that reclaiming can not be performed.

On the other hand, at the step 2, a lamp for indicating that the filter is being reclaimed is turned on, and then the routine goes to a step 3.

At the step 3, electrical current is caused to start to pass through the glow plug 20, and then the routine goes to a step 4.

At the step 4, it is determined whether or not the time $t_G$ for which electrical current passes through the glow plug 20 is greater than a preselected time $T_G$. When it is greater than the preselected time $T_G$, the routine goes to a step 5, and when it is not, the routine returns to the step 3.

At the step 5, the injection nozzle 17 and passage closing valve 18 are operated, so that fuel and exhaust for combustion are introduced into the combustion equipment 16. As a result, the ignition of the introduced fuel is performed by means of the glow plug 20 so that combustion process starts to be performed in the combustion equipment 16. By this combustion process, the exhaust particles trapped by the first and second filters 14 and 15 are caused to burn by means of an elevated temperature of exhaust, so that the filters 14 and 15 are reclaimed. Then, the routine goes to a step 6.

At the step 6, electrical current passing through the glow plug 20 is stopped, and then the routine goes to a step 7.

At the step 7, it is determined whether or not the combustion time $t_R$ in the combustion equipment 16 is greater than a preselected time $T_R$, for example, 15 to 30 minutes. When it is greater than the preselected time $T_R$, the routine goes to a step 8. On the other hand, when it is not, the routine returns to the step 5 and the combustion process continues.

At the step 8, the operation of the injection nozzle 17 is stopped and the passage closing valve 18 is closed, so that the operation of the combustion equipment 16 is stopped. Then, the routine goes to a step 9.

At the step 9, the lamp for indicating that the reclaiming is being performed is turned off, and the routine goes to a step 10.

At the step 10, a buzzer for informing the driver or mechanic that the reclaiming of the filter is finished is turned on, and the routine comes to an end.

According to the present invention, the following effects are obtained.

Conventionally, the volume of the filter mounted on a large vehicle, such as a bus or a truck, is limited due to pressure loss, collection efficiency and so forth, so that it becomes equal to or greater than cubic capacity or displacement of the engine. For example, when cubic capacity of the engine is about 10 liters, the filter volume becomes equal to or greater than 10 liters. In the case of such an engine, the distribution of the exhaust flow within the filter becomes uneven, so that the exhaust particles tend to be trapped particularly near the center of the filter, compared with near the periphery thereof. As a result, there is a disadvantage in that burnout of the filter tends to occur due to heat distortion. In addition, if the area of the inlet of the filter is decreased and the length thereof in a direction along the exhaust passage is increased, there is a disadvantage in that a difference in temperature distribution occurs along the exhaust passage in the filter. As a result, heat distortion occurs, so again, burnout tends to occur. Particularly, in a case where the reclaiming of the filter is performed by means of a burner, it is very difficult to evenly reclaim the filter since a difference in temperature distribution occurs near the inlet thereof. As a result, the pressure of exhaust gas increases due to a great amount of exhaust particles remaining within the filter, so that the performance of the engine is not only degraded, but, in a worst case, the filter is also in danger of melting.

On the other hand, according to the present invention, the first and second filters 14 and 15 are arranged within the exhaust passage 13 in series. With this construction, the collection efficiency of the filter can be increased, and the pressure loss thereof can be reduced. In addition, the filter can be made to be compact, which makes the exhaust flow distribution and the temperature distribution even.

Figure 3:
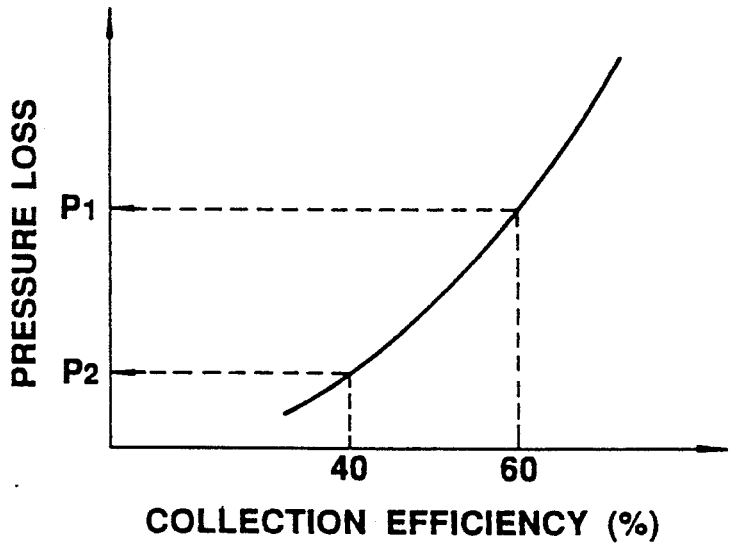
FIG. 3 is a graph showing the relationship between the collection efficiency and the pressure loss of a filter of an exhaust particle removing system.
Figure 4:
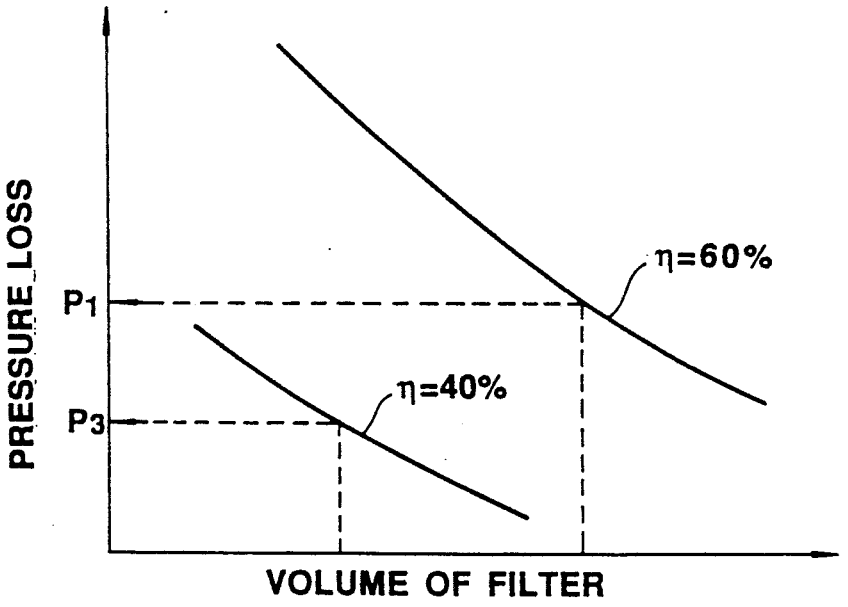
FIG. 4 is a graph showing the relationship between the volume and the pressure loss of the filter.

Referring to FIGS. 3 and 4, the advantage obtained by the present invention is described below. FIG. 3 shows the relationship between the collection efficiency and pressure loss in a filter. As can be seen clearly from this graph, as the collection efficiency of the filter increases, the pressure loss thereof increases, since the average diameter of the pores decreases.

For example, when the target collection efficiency is 60%, the pressure loss is $P_1$, and when target efficiency is 40%, it decreases to $P_2$.

FIG. 4 shows the relationship between the volume of the filter and the pressure loss. As can be seen clearly from this graph,. in a case where the collection efficiency is constant, i.e. the average diameter of the pores is constant, the pressure loss increases as the volume of the filter decreases. In addition, in a case where the volume of the filter is constant, the pressure loss decrease as the collection efficiency decreases.

Therefore, to use a filter having a small collection efficiency can make the pressure loss very small if the volume thereof is small.

For example, when a filter having a 40% collection efficiency is used, the pressure loss is half that of a filter having a 60% collection efficiency, if the volume is reduced to half. Now, assuming that the pressure loss of a filter having a 60% collection efficiency is available, if two filters, each having a 40% collection efficiency, are arranged in series, the pressure loss can be kept within set limits. This arrangement can make the total collection efficiency of these two filters 64%, and the volume of each of the filters to be half. Particularly, in the case of arranging two cylindrical filters in series, each of which has the width of the inlet being equal to the length thereof, the width of the inlet of one filter can be decreased by about 40%.

Therefore, according to the present invention, since small diameter, small volume of filters are arranged in series, a higher collection efficiency can be maintained while pressure loss is decreased. In addition, the distribution of the flow rate and the temperature distribution during reclaiming can be held even, so that it is possible to prevent burnout due to heat distortion from occuring.

Furthermore, according to the present invention, the combustion equipment 16 is provided upstream of the first filter 14, and only the second filter 15 is coated with catalyst. Therefore, exhaust particles trapped by the filter can be smoothly removed to reclaim the filter while gaseous SOF, HC, and CO can be oxidized to be reduced by means of the catalyst so as to prevent emission of these gases. That is, the SOF in the exhaust particles usually exists in the atmosphere at atmospheric pressure, and the greater part of the exhaust in the exhaust passage 13 is more nearly gaseous than particulate. Therefore, although the exhaust can not be fully trapped by means of a porous filter, the gaseous SOF can be converted at an exhaust temperature greater than 200° C. by means of a catalyst-coated filter, according to the present invention. In addition, since the SOF exists in a mist state at temperatures less than 200°, it is trapped by the filter so as not to be emitted into the atmosphere.

Next, referring to FIGS. 5 and 6, the reason for which the first filter 14 is not coated with catalyst is described below.

Figure 5:
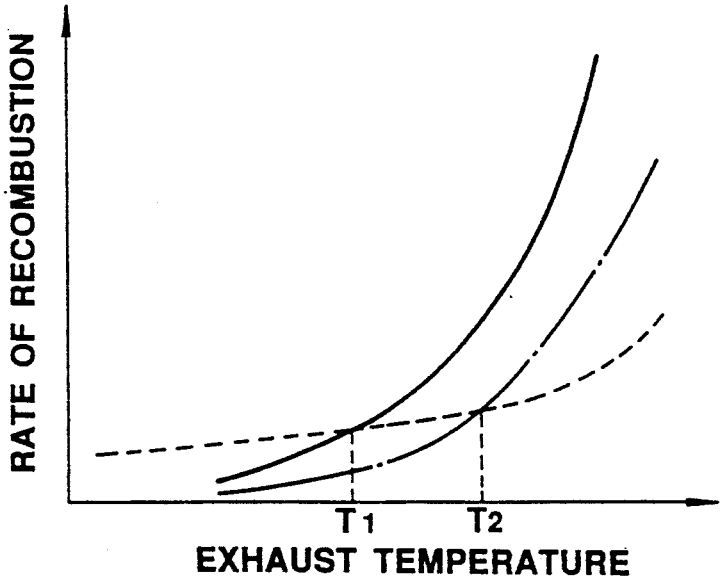
FIG. 5 is a graph showing a recombustion characteristic of exhaust particles within the filter.

FIG. 5 shows a recombustion characteristic of the exhaust particles within the catalyst-equipped filter. In FIG. 5, the solid line indicates the recombustion rate of the exhaust particles relative to the exhaust temperature. The recombustion rate increases as the exhaust temperature increase as an exponential function. The broken line indicates the volume of the exhaust particles trapped by the filter relative to the exhaust temperature. The trapped volume increases as the exhaust temperature increases, i.e. the load on the engine increases.

The exhaust temperature $T_1$ at the intersection between the solid and broken lines indicates a temperature at which the reclaiming starts to be performed, which will be referred to as "reclaiming starting temperature". When the exhaust temperature is less than the reclaiming starting temperature, the exhaust particles are trapped and deposited on the filter, and when it is greater than the reclaiming starting temperature, the exhaust particles are reburned as they pass through the filter, so as to prevent the exhaust particles from being deposited thereon. However, when the catalyst is exposed to high temperatures for a long time, the reclaiming capacity thereof is reduced due to heat deterioration. That is, as shown by the chain line of FIG. 5, the reclaiming starting temperature shifts toward a higher temperature, and the recombustion rate of the exhaust particles greatly decreases when the exhaust temperature is relatively high. The heat deterioration occurs at an exhaust temperature of 650° C. to 700° C., and is relatively small at a temperature less than about 600° C. Therefore, in the case of using a catalyst-equipped filter, it is necessary to considering how heat deterioration is to be controlled. That is, the driving condition of the engine varies from idle running to top-speed running conditions, and the exhaust temperature near the outlet of the turbo-supercharger varies from 100° C. to 700° C.

depending upon the driving conditions of the engine. Therefore, in a case where the available temperature for the catalyst is assumed to be 600° C., the catalyst-equipped filter must be arranged at a location separated from the outlet of the turbo-supercharger by a predetermined distance, in order to maintain the exhaust temperature near the catalyst to be a temperature less than the aforementioned available temperature until the driving condition varies to the top-speed running condition. On the other hand, when the distance between the catalyst-equipped filter and the outlet of the turbo-supercharger is too great, the exhaust temperature near the filter can not reach at the reclaiming temperature. Therefore, the filter must be arranged at an appropriate location.

As mentioned above, the exhaust particles trapped by the first filter 14 are reburned by the combustion operation of the combustion equipment 16. In addition, the mounting positions of the combustion equipment 16 and the first and second filters 14 and 15 must be determined so that the exhaust particles containing the SOF trapped by the second filter 15 can be reburned by the aforementioned combustion operation. That is, in order to determine the position of the second filter 15, it is required to consider the rise in temperature due to combustion of exhaust particles deposited on the first filter 14, so that the temperature near the second filter 15 can be less than the available temperature for the catalyst and the reclaiming of the filter can be smoothly performed.

Figure 6:
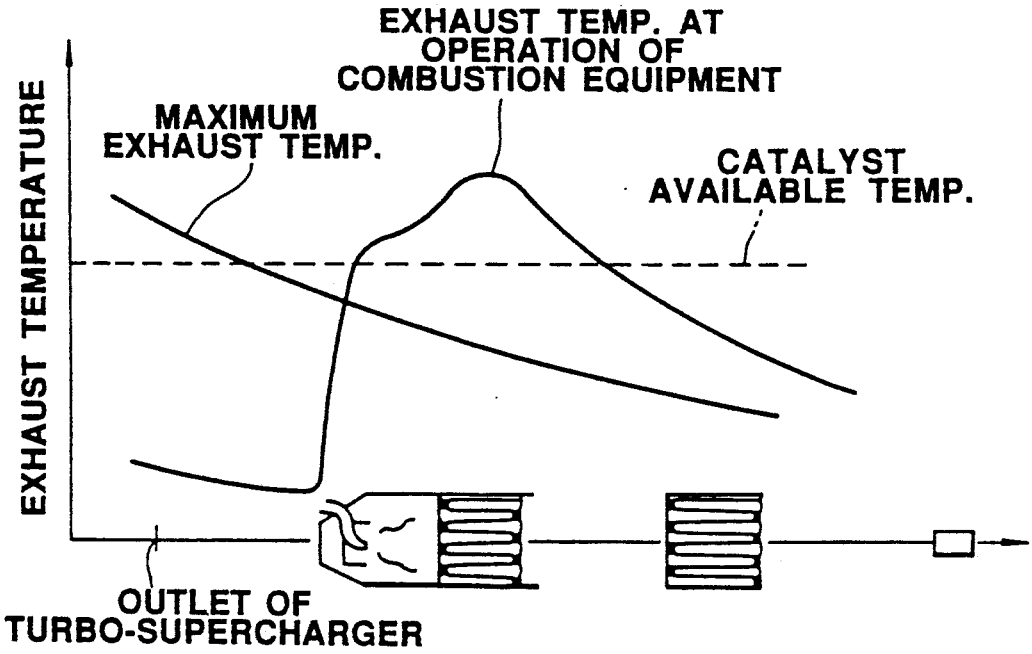
FIG. 6 is the exhaust temperature passing through filters of the exhaust particle removing system of FIG. 1 relative to the position of the particles.

An additional reason why the first filter 14 is not coated with catalyst is that, even if the first filter 14 is coated with a catalyst, heat deterioration of the catalyst occurs immediately, since, as shown in FIG. 6, the temperature within the first filter 14 becomes greater than the maximum temperature at which the catalyst can smoothly perform the reclaiming of the second filter 15. Therefore, coating the first filter 14 with catalyst is not required since the temperature within the first filter 14 increases smoothly to the reclaimable temperature (about 600° C. to 700° C.) by means of the combustion equipment 16.

Furthermore, according to the preferred embodiment of the present invention, the exhaust upstream of the turbo-supercharger 11 is introduced into the combustion equipment 16 for combustion thereof. Therefore, provision of a large air pump for supplying air to the combustion equipment 16, which is provided in prior art systems is not required. As a result, costs are decreased, and power loss and fuel consumption incurred by driving an air pump are avoided.

What is claimed is:

1. An exhaust particle removing system for an engine, comprising:

a first filer disposed in an engine exhaust passage for trapping particles unopened in exhaust gas;

combustion means disposed near the inlet of the first filter for burning off particles deposited on the first filter; and a second filer, disposed in the engine exhaust passage downstream of the fist filter in series therewith for trapping particles suspended in exhaust gas passing through the first filter, said second filter being coated with a catalyst and separate from the first filer by a predetermined distance so that h particles deposited on the second filter are burned off by means of an elevated temperature of gas passing through the first filter.

2. An exhaust particle removing system as set forth in claim 1, wherein each of said first and second filters comprises a honeycomb structure, and has a plurality of parallel holes extending between the upstream and downstream ends of the respective filter, said holes being of first and second types, the holes of the first type having open upstream ends and closed downstream ends, the holes of the second type having open downstream ends and closed upstream ends, said fist holes adjoining said second holes via porous walls of the respective filter so that the exhaust gas fist enters the first holes and then passes through the porous walls into said second holes before exiting via said second holes.

3. The exhaust particle removed system as set froth in claim 1, wherein the length of each of first and second filers is essentially equal to the diameter of the respective filter.

4. An exhaust particle removing system as set forth in claim 3, wherein said catalyst has the ability to oxidize and reduce gaseous SOF, HC, CO contained in said particles.

5. An exhaust particle removing system as set forth in claim 3, wherein exhaust from the upstream of a turbo-supercharger of said engine is introduced into said combustion means for burning the particles.

6. An exhaust particle removing system as set forth in claim 1, wherein the length of each of said fist and second filters is less than the diameter o the respective filter.

* * * * *